United States Patent [19]

Wells et al.

[11] 4,101,622

[45] Jul. 18, 1978

[54] METHOD OF CASTING BEVELED PIPE

[75] Inventors: Frank M. Wells, Aztec, N. Mex.; Gordon J. Black, Nuevo, Calif.

[73] Assignee: Ameron, Inc., Monterey Park, Calif.

[21] Appl. No.: 645,382

[22] Filed: Dec. 30, 1975

Related U.S. Application Data

[60] Continuation of Ser. No. 488,545, Jul. 15, 1974, abandoned, which is a division of Ser. No. 385,189, Aug. 2, 1973, Pat. No. 3,856,453.

[51] Int. Cl.[2] ..... B28B 1/14

[52] U.S. Cl. ..... 264/251; 249/84; 249/100; 264/254; 264/271; 264/275; 264/308; 264/333

[58] Field of Search ..... 264/250, 251, 271, 299, 264/308, 333, 71, 69, 256, 254, 273, 275; 249/100, 84; 425/447; 138/175

[56] References Cited

U.S. PATENT DOCUMENTS

| | | | |
|---|---|---|---|
| 1,298,647 | 4/1919 | Bewley | 425/447 X |
| 1,453,269 | 5/1923 | Buente | 425/447 X |
| 2,161,822 | 6/1939 | Kogl | 249/137 |
| 2,858,594 | 11/1958 | Eirich | 425/447 X |
| 3,087,201 | 4/1963 | Williams | 264/275 X |
| 3,492,395 | 1/1970 | Breitfuss | 264/308 |

*Primary Examiner*—Thomas P. Pavelko
*Attorney, Agent, or Firm*—Christie, Parker & Hale

[57] ABSTRACT

A pipe mold for vertically cast concrete pipe includes a cylindrical outer mold case, a cylindrical core spaced inside the mold case, and a pipe-reinforcing cylinder between the core and the case. A system for casting concrete in the pipe mold includes a flat facing ring above the annular space between the mold case and the cylinder. A chute assembly mounted concentrically above the pipe mold includes several radially extending and spaced apart pouring chutes extending downwardly from the center of the chute assembly to corresponding circumferentially spaced apart openings in the facing ring. The pouring chutes channel the flow of concrete into the openings in the facing ring to fill the pipe mold to the bottom surface of the facing ring, which forms a flat annular end section at the desired elevation on the pipe. The facing ring eliminates the need for hand finishing and measuring which is common in the prior art manufacture of vertically cast concrete pipe. A concrete pipe with a beveled end section is formed by mounting the facing ring in an angular plane above the pipe mold. As the concrete is channeled into the openings of the beveled facing ring, gates in the pouring chutes are sequentially closed to progressively block the rise of concrete from the low side to the high side of the facing ring until the pipe mold is filled to the bottom of the ring which automatically forms a flat, beveled annular end section at the desired elevation on the pipe.

13 Claims, 8 Drawing Figures

METHOD OF CASTING BEVELED PIPE

CROSS REFERENCE TO RELATED APPLICATIONS

This is a continuation of application Ser. No. 488,545, filed July 15, 1974, now abandonded which in turn, is a division of application Ser. No. 385,189, filed Aug. 2, 1973, now U.S. Patent No. 3,856,453.

BACKGROUND OF THE INVENTION

This invention relates to the art of casting concrete pipe, and more particularly to a novel method and apparatus for pouring concrete into a vertically oriented pipe mold.

In the manufacture of certain types of large-diameter concrete pipe, for instance pipe having a diameter as wide as 20 feet, concrete is poured into a vertically disposed pipe mold comprising a cylindrical outer mold case and a cylindrical inner core. In most instances, the pipe is reinforced with a relatively thin-walled cylindrical steel shell, or cylinder, which is disposed in the pipe mold between the outer mold case and the inner core and becomes embedded in the pipe wall when concrete is cast in the pipe mold. The top of the cylinder generally is provided with a spigot-type end ring. When the concrete is poured into the annular space between the mold case and the cylinder, the top level of the concrete is "foreshortened" to form a flat annular end section which is spaced below the spigot ring so that during use, the spigot ring of the pipe can be joined with a cooperating bell-type end ring of an adjoining concrete pipe section.

In some instances, concrete pipe is cast as a straight pipe section in which the spigot ring and the foreshortened annular end section of the pipe lie in separate horizontal planes. In other instances, concrete pipe is cast as a beveled pipe section in which the spigot ring and the foreshortened annular end section lie in planes which are inclined relative to the axis of the pipe.

In the conventional method of casting concrete pipe, a "tamping top" is mounted on top of the pipe mold. The tamping top includes a "spigot round-up ring" engaged with the spigot ring to hold the top of the reinforcing cylinder in a fixed position, and a ring-shaped "halo bar" engaged with the top of the outer mold case to hold the case in a fixed position and maintain equal spacing between the reinforcing cylinder and the mold case. The tamping top forms a continuous annular opening between the cylinder and the mold case through which concrete is to be poured. Once the tamping top is in place, an inverted conical-shaped "pouring cone" is placed above the center portion of the tamping top. Concrete is then emptied from a bucket onto the top of the pouring cone which distributes the concrete evenly through the annular opening in the tamping top. The pouring cone also evenly distributes concrete to the annular space between the cylinder and the inner core. The space between the outer mold case and the cylinder generally is overfilled above its desired elevation, and after the pouring cone is removed, excess concrete at the top of the mold is then dug out by hand, measured with a depth gauge, and handtroweled to provide a flat, properly leveled annular end section for the pipe.

The job of hand-finishing the foreshortened annular end section of the pipe is a time-consuming and costly process, particularly because of the large size of the pipe, and because the finished end section of the pipe must meet relatively narrow tolerances. Beveled pipe in particular is laborious and costly to finish. The pipe form for beveled pipe generally is overfilled to form a horizontal annular end section, and the excess concrete on the low side of the bevel is then dug out and finished to the desired bevel by offset measurements which require substantial time and effort by the workmen.

SUMMARY OF THE INVENTION

This invention provides a system for vertically casting concrete pipe in such a way that the time-consuming and laborious prior art job of hand-finishing the annular end section of the pipe is substantially eliminated.

Briefly, the system includes a pipe mold having an outer mold case and an inner cylinder spaced concentrically inside the outer mold case. A flat facing ring is mounted above the annular space of the pipe mold, and a downwardly extending pouring chute is mounted concentrically above the pipe mold. The pouring chute is in communication with an opening in the facing ring. The pouring chute channels the flow of concrete into the opening in the facing ring, and the concrete is distributed in the annular space of the pipe mold until the mold is filled. When the concrete is filled to the bottom of the facing ring, the facing ring forms a flat, automatically leveled annular end section for the pipe which eliminates the need for the hand-finishing and measuring which are common in the prior art.

The facing ring may be mounted in a substantially horizontal plane to form the end section of a straight pipe, or it may be mounted in a plane which is inclined relative to the horizontal to form a beveled end section for the pipe.

In a preferred form of the invention, several radially extending and circumferentially spaced apart pouring chutes are aligned with corresponding circumferentially spaced apart openings in the facing ring. In instances where a beveled pipe section is produced, concrete is channeled into the openings of the facing ring by the pouring chutes until the concrete level reaches the low side of the facing ring. Thereafter, as pouring continues, gates in the pouring chutes are sequentially closed to progressively block the rise of concrete from the low side to the high side of the facing ring until the concrete is filled to the bottom of the facing ring, which will automatically provide a planar, beveled annular end section for the pipe.

These and other aspects of the invention will be more fully understood by referring to the following detailed description and the accompanying drawings.

DETAILED DESCRIPTION OF THE PREFERRED EMBODIMENTS

Figure 1:
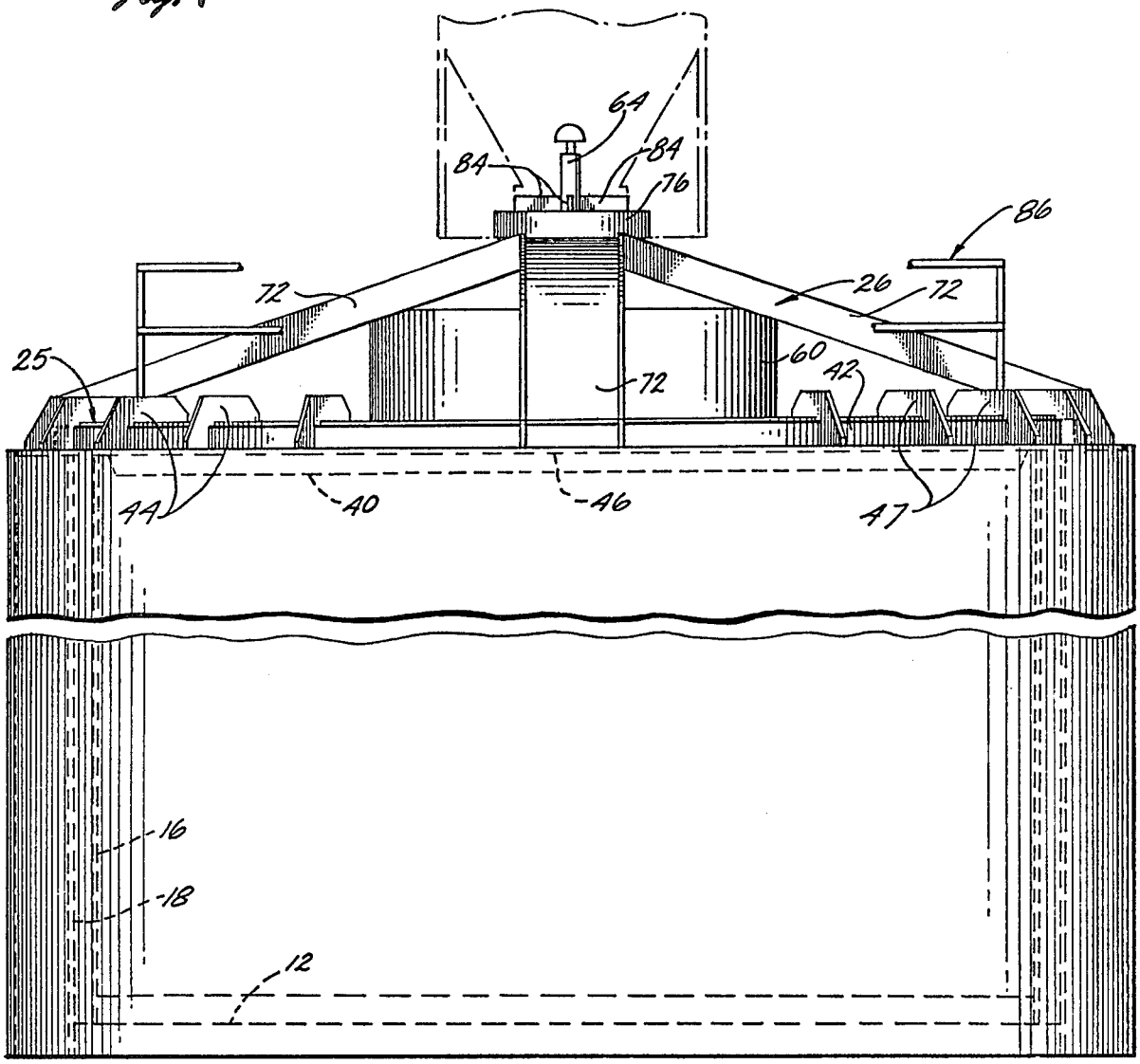
FIG. 1 is a fragmentary elevation view showing a facing ring and pouring chute assembly in accordance with this invention mounted on a vertically disposed pipe mold for use in casting concrete in the pipe mold.

Referring to FIG. 1, a system for casting a concrete pipe section includes a vertically disposed pipe mold assembly 10 mounted over a base ring 12 on the ground to provide means for holding the bottom of the pipe mold components in a fixed position relative to each other. The pipe mold comprises a cylindrical steel outer mold case 14 and a cylindrical steel core 16 placed concentrically inside the outer mold case. A relatively thin-walled steel shell or cylinder 18 is disposed in the pipe mold between the outer mold case and the core. During use of the pipe mold, concrete is poured into the outer annular space between the mold case and the cylinder and into the inner annular space between the cylinder and the core to form a concrete pipe section. Thus, cylinder 18 becomes embedded in the concrete to provide reinforcing for the pipe section.

The concrete pipe section has a bell-type end at its bottom and a spigot-type end at its top. As shown best in FIG. 3, the spigot end of the pipe includes a rigid metal spigot ring 20 at the top of cylinder 18. A concrete inner lining 22 of the pipe is poured to the top of the spigot ring, and a concrete outer layer 24 of the pipe is poured to a foreshortened positioned relative to the top of inner lining 22. In a belled end of the pipe the bottom of the concrete inner lining 22 is foreshortened relative to the bottom of concrete outer layer 24.

The concrete is poured into pipe mold 10 with the aid of a top ring 25 mounted on the top edge of inner core 16, and a pouring chute assembly 26 mounted over the center portion of the top ring. The detailed construction of the top ring will be understood best by referring to FIGS. 2 through 5. Top ring 25 includes a pair of flat semi-circular plate halves 28 mounted in a diametrically opposed relation on a rigid supporting framework so the plate halves form the equivalent of a circular plate which covers the circular opening above the center of mold case 10. The supporting framework for the top ring includes a plurality of radially outwardly extending support members 30, each of which includes a pair of opposed C-shaped channel bars 32 rigidly secured together to form the equivalent of an I-beam. Plate halves 28 are welded to the top of the I-beams. Circumferentially spaced apart openings 34 in the plate halves are covered with wire mesh to provide vent holes for the central portion of the top ring.

An inner round-up ring 36 is rigidly secured to the outer edges of I-beams 30 and plate halves 28. The outer edge of the inner round-up ring is notched to form an annular shoulder 38 adapted to rest on the annular top edge of core 16 to hold the top ring in place on top of the pipe mold. A guide ring 40 below the inner round-up rings extends diagonally downwardly and inwardly toward the center of the top ring. The bottom of the guide ring is rigidly secured to the bottom outer edge of the I-beams to hold the guide in a fixed position for use in guiding the top ring into position above the pipe mold.

An outer round-up ring 42 is held in a fixed position spaced outwardly from and concentric relative to inner round-up ring 36. The inner and outer round-up rings forms an annular opening 43 in the top ring above the annular mold cavity between core 16 and cylinder 18. During use of the top ring, concrete is poured through annular opening 43. A plurality of circumferentially spaced apart bridge bars 44 are rigidly secured to the tops of I-beams 30 and to the tops of the inner and outer round-up rings to hold the two rings in a fixed, equidistantly spaced apart relation. When the top ring is mounted on the pipe mold, the inner face of outer round-up ring 42 abuts against the outer face of spigot ring 20. Thus, the inner and outer round-up rings maintain the top portions of core 16 and cylinder 18 in a fixed equidistantly spaced apart relation which maintains a true annular open space between the cylinder and the core.

An outwardly extending flat facing ring 46 is rigidly secured to the bottoms of outer round-up ring 42 and bridge bars 44 to hold the facing ring at a fixed elevation below the top edges of core 16 and spigot ring 20. The outer edge of facing ring 46 engages the inner edge of mold case 14 to hold the top of the mold case in a fixed spaced-apart position relative to the top ring, thereby maintaining a fixed continuous width for the annular mold cavity between mold case 14 and cylinder 18. The bottom of the facing ring forms the top of a foreshortened annular end section 47 of outer layer 24 of the cast concrete pipe section.

Figure 2:
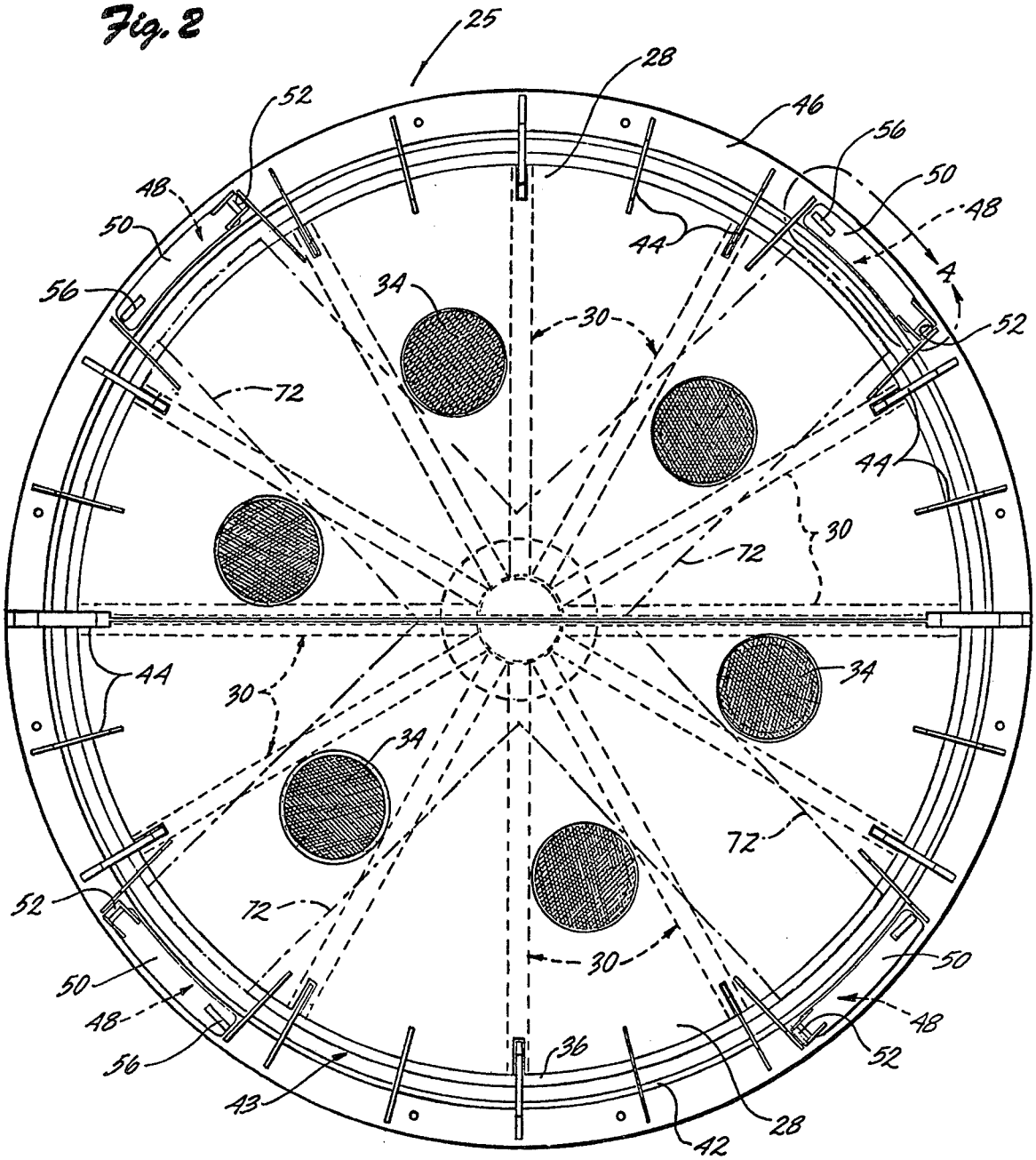
FIG. 2 is a plan view showing the detailed construction of the facing ring.
Figure 4:
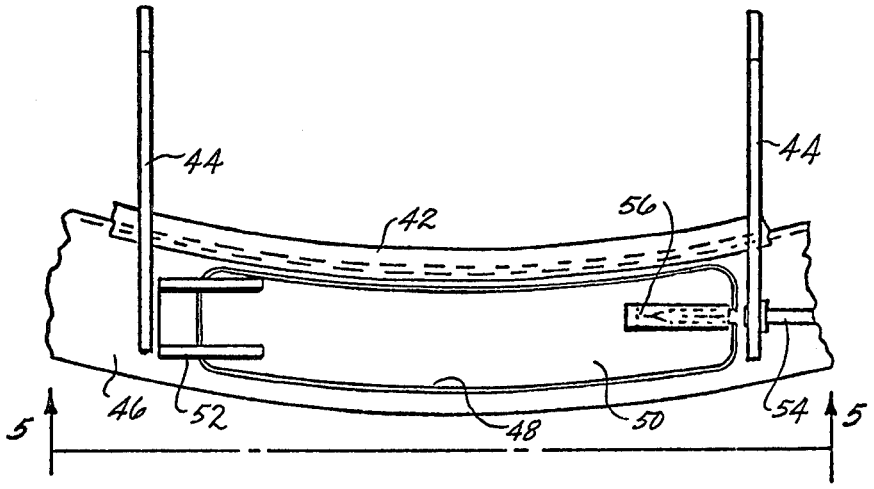
FIG. 4 is an enlarged fragmentary plan view showing a facing ring door assembly taken within the circle 4 of FIG. 2.
Figure 5:
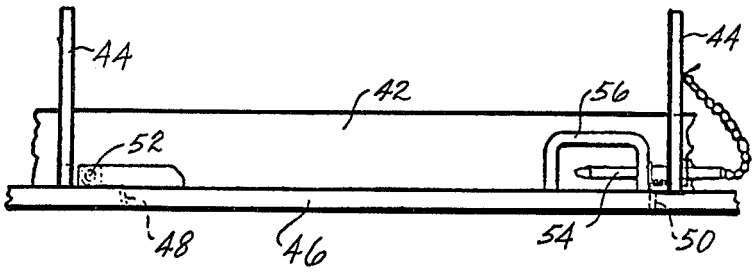
FIG. 5 is a fragmentary elevation view taken on line 5—5 of FIG. 4.

As shown best in FIGS. 2, 4, and 5, several circumferentially spaced apart openings 48 are formed in facing ring 46, preferably at equidistantly spaced apart locations around the ring. As shown best in FIG. 2, the openings occupy a small portion of the facing ring area. Each opening 48 is covered by a respective door 50 having a hinge 52 at one end thereof to allow the door to be either opened, by pivoting it upwardly from the top of the facing ring, or closed by lying flush against the top of the facing ring over opening 48. The opposite end of each door includes a separate locking pin 54 which engages a corresponding opening in a handle 56 to form a releasable lock for the door. The underside of each door is shaped to lie in the same plane as the bottom of facing ring 46 so the bottom of the facing ring will provide a continuous flat engaging surface for use in forming a flat top surface for end section 47 of the pipe.

Figure 6:
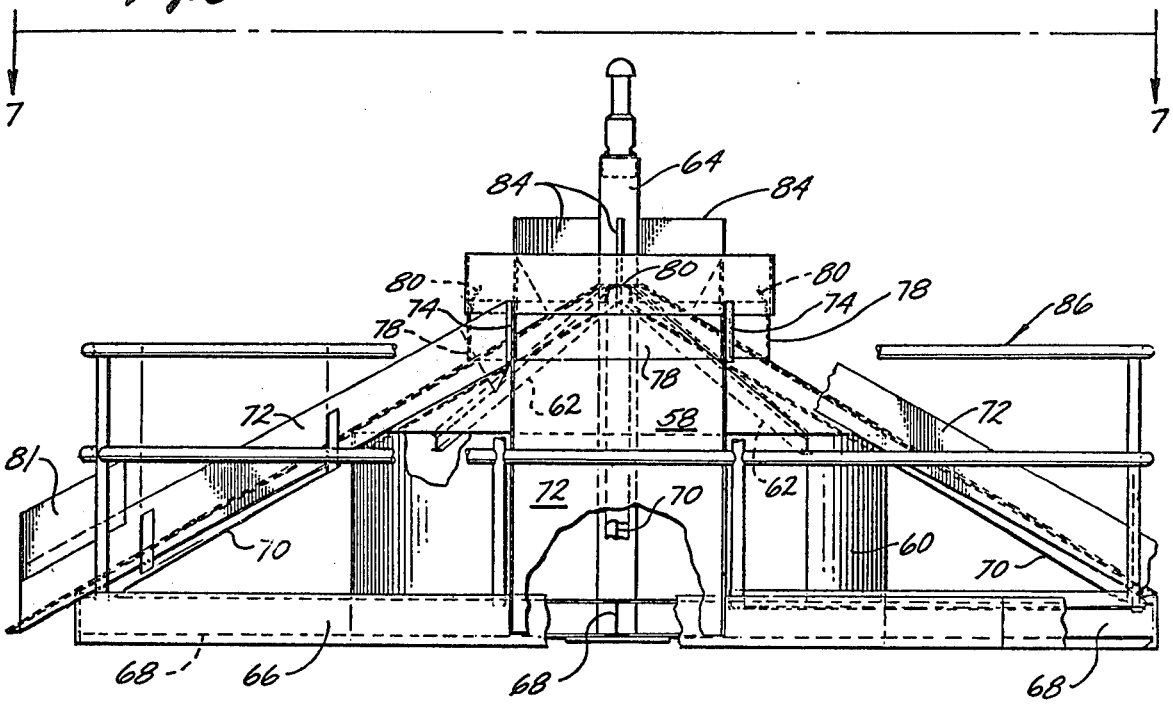
FIG. 6 is a fragmentary elevation view, partly in cross-section and partly broken away, showing the detailed construction of the pouring chute assembly shown in FIG. 1.
Figure 7:
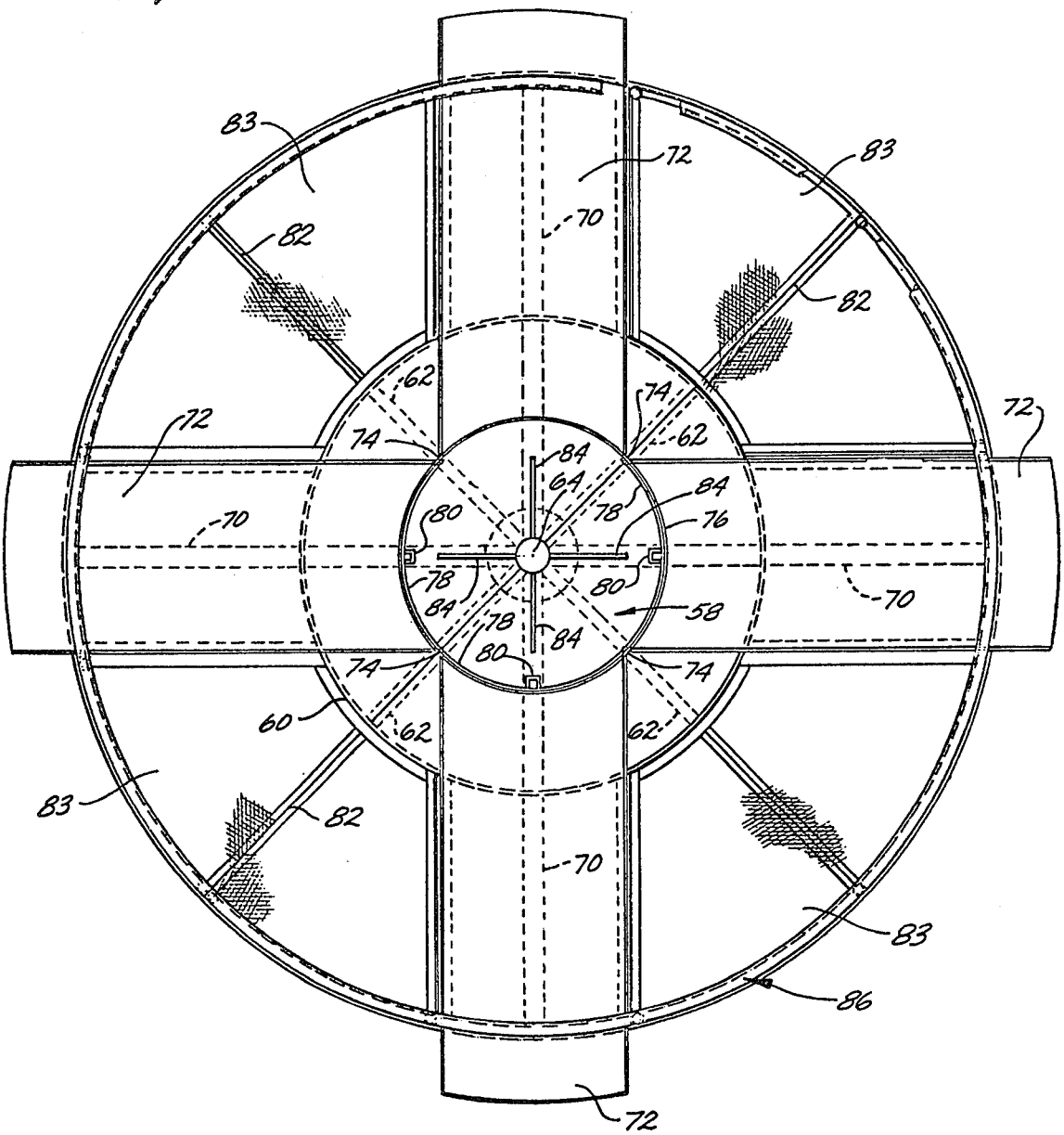
FIG. 7 is a plan view taken on line 7—7 of FIG. 6.

Pouring chute assembly 26 is understood best by referring to FIGS. 1, 6 and 7. The central area of the pouring chute assembly includes an inverted conical shaped metal pouring cone 58 supported on an upright annular frame 60, the top edge of which is rigidly secured to the bottom annular edge of the pouring cone. A plurality of radially outwardly and downwardly extending I-beams 62 are welded to the underside of pouring cone 58 to provide rigid support for the pouring cone base. The outer ends of I-beams 62 are rigidly secured to the top inner upright edge of annular frame 60.

Pouring cone 58 is centered around an upright rigid arm 64 extending along the vertical axis of the pouring chute assembly. The inner edges of I-beams 62 are rigidly secured to the outer edge of arm 64.

An outer base ring 66 forms the bottom of the pouring chute assembly. The base ring is rigidly braced by radially spaced apart, horizontally extending I-beams 68. The bottom of annular frame 60 is rigidly secured to the tops of I-beams 68 to center pouring cone 58 above base ring 66. The pouring cone is further interconnected with the base ring by radially outwardly and downwardly extending I-beams 70, the top edges of which are rigidly secured to the underside of the pouring cone. The inner edges of I-beams 70 are secured to the outer edge of arm 64, and the outer edges of I-beams 70 are rigidly secured to the inner vertical edge of base ring 66 to provide a rigid supporting framework for the pouring chute assembly.

As shown best in FIG. 7, I-beams 70 are spaced 90° apart, and each I-beam provides support for the bottom of a corresponding one of four radially outwardly and downwardly extending, upwardly opening, U-shaped pouring chutes 72. Each pouring chute 72 extends radially outwardly beyond the outer extent of base ring 66. The side walls of each pouring chute terminate at their top ends adjacent a plurality of radially spaced apart and vertically extending support bars 74. A horizontally disposed, relatively thin-walled ring 76 made of flat sheet metal is secured to the tops of support bars 74 to be held above the tops of the pouring chutes in a position centered with respect to arm 64. A separate arcuate slotted opening is formed between the base of each pouring chute and the bottom of ring 76,. Three of these openings are closed off by separate arcuately curved, vertically slidable, elongated gate members 78. The top portion of each gate member abuts against the inner edge of ring 76. Each gate member has a corresponding upwardly and inwardly extending handle 80 which can be used to pull the gate member upwardly to open the space between the base of the pouring chute and the bottom of ring 76.

The pouring chute assembly also includes four radially extending and equidistantly spaced apart, horizontally disposed composite I-beams 82 extending outwardly from the bottom of arm 64 to the outer base ring 66. I-beams 77 provide support for separate screen sections 83 which cover the spaces between the pouring chutes. Four equidistantly spaced apart, vertically disposed support members 84 are secured at their inner edges to the outer edge of arm 64. Support members 84 extend radially outwardly therefrom in an equidistantly spaced apart relation. The pouring chute assembly also includes an upright hand rail 86 which spans the outer edge of the pouring chute assembly to provide means for allowing workmen to steer the pouring chute assembly into place when it is mounted above top ring 25.

Figure 3:
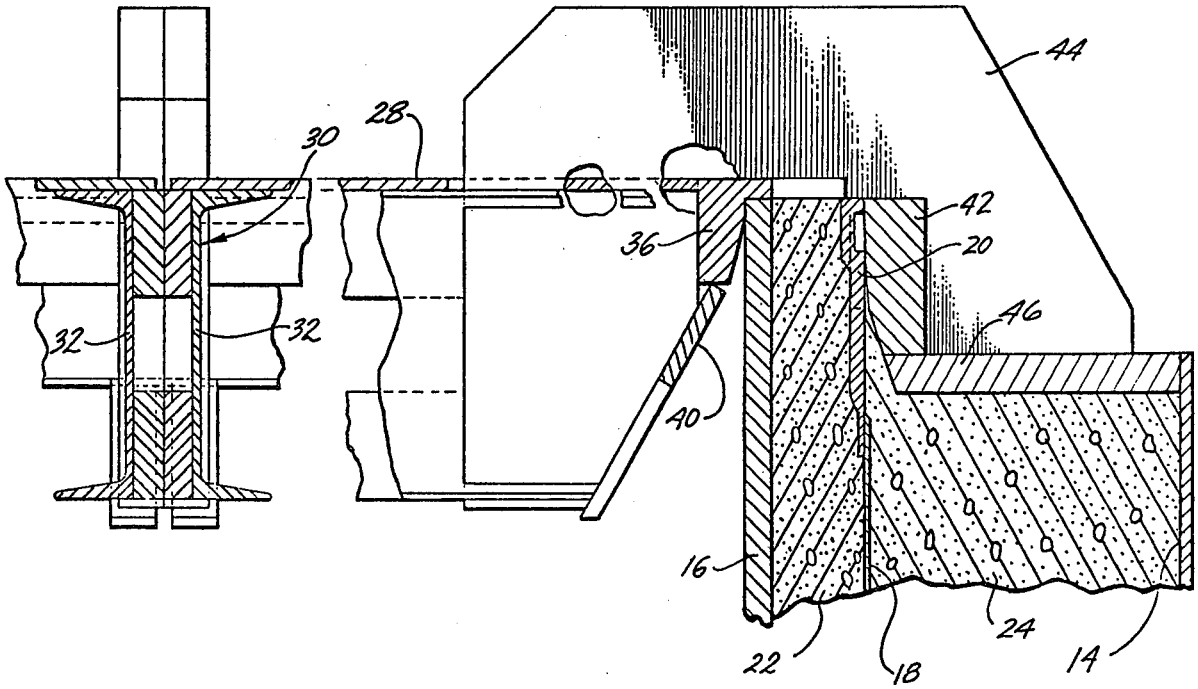
FIG. 3 is a fragmentary cross-sectional elevation view showing the facing ring mounted on top of the pipe mold.

During use of the top ring and pouring chute assembly, a crane (not shown) hoists the top ring above the pipe mold and places the top ring on top of core 16 in the position shown best in FIGS. 1 and 3. Outer mold case 14 is hoisted up and then lowered into position around the top ring so the top inner edge of the outer mold case engages the outer edge of facing ring 46. The crane then hoists pouring chute assembly 26 above the top ring, and workmen position the assembly so that the four pouring chutes 72 are aligned with the four door openings 48 of facing ring 46, as illustrated best in phantom line in FIG. 2. (Depending upon the size of the pipe to be cast, three, two, and even one pouring chute and facing ring door opening may be used.) When the pouring chute assembly is in place above the top ring, base ring 66 of the pouring chute assembly rests on top of the central circular plate of the top ring. As shown best in FIG. 2, when the pouring chute assembly is in its proper position, the extreme outer edges of pouring chutes 72 rest on top of inner round-up ring 36 and extend to the outer vertical edge of the inner round-up ring. Concrete is then ready to be poured into the pipe mold from a bucket 78 (illustrated in phantom line in FIG. 1) which is hoisted above the pouring chute assembly by the crane. The bucket is lowered over arm 64 which engages a releasable gate assembly in the bottom of the bucket in a manner well known in the art to pour the concrete on pouring cone 58. This allows the concrete to be channeled through the open gates of the pouring chutes and into the pipe mold. A major portion of the concrete poured on the chute assembly will be channeled to the inner mold cavity between core 16 and cylinder 18. Preferably, the pipe mold is filled by alternately pouring concrete into the inner mold cavity and then the outer mold cavity (between case 14 and cylinder 18), but always keeping the inner mold cavity filled to a higher level than the outer mold cavity to prevent collapsing cylinder 18. When the outer mold cavity is to be filled, suitable hinged extension means 80 (only one of which is shown in FIG. 6 for clarity) at the end of each pouring channel are rotated into place to extend the length of the pouring chutes so that the concrete can be poured directly into the outer mold cavity only through the door openings in facing ring 46. This method of pouring the concrete into the pipe mold is continued until the inner and outer mold cavities are filled. The outer mold cavity is poured to the bottom of facing ring 46, and doors 50 are then closed. The facing ring forms a continuous, flat, foreshortened, annular end section at the proper elevation on the pipe. This eliminates the prior arts steps of removing substantial excess material from the end section of the pipe, and also reduces the substantial amount of hand-finishing common in the prior art. The facing ring also has the advantage of establishing the exact elevation of the pipe end section without the requirement of constantly gauging the level of the end section as it is being hand troweled.

Figure 8:
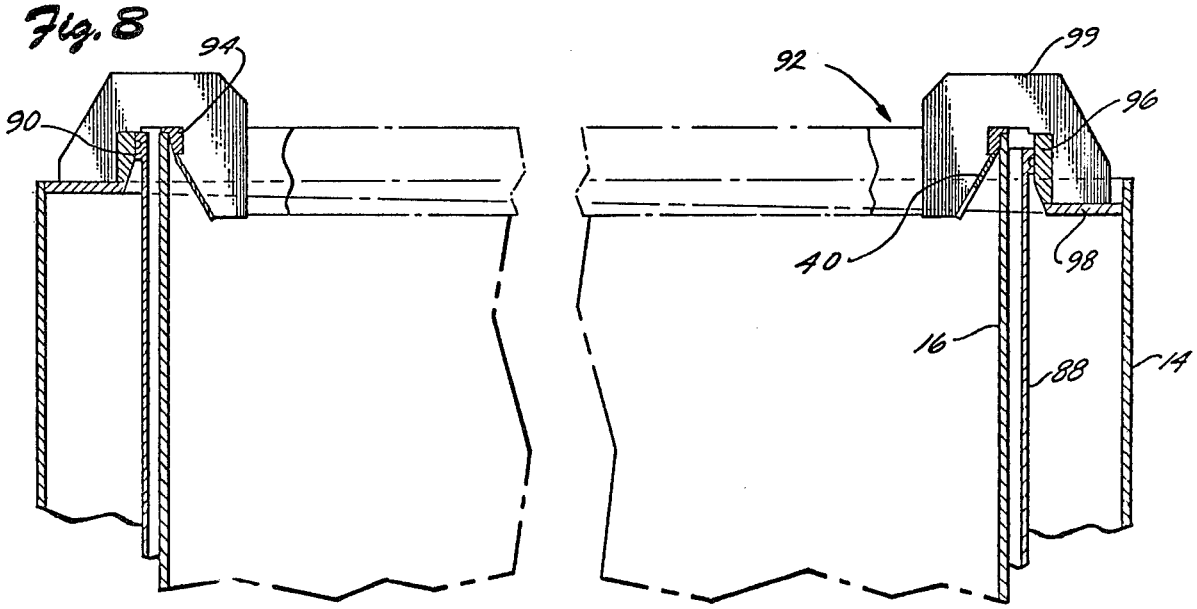
FIG. 8 is a fragmentary cross-section elevation view showing the facing ring assembly of this invention mounted on a pipe mold for forming a beveled pipe section.

FIG. 8 illustrates a system for casting beveled pipe sections. In FIG. 8 the bevel angle of the pipe is exaggerated for clarity. When casting beveled pipe sections, the same pouring chute assembly as that described in FIGS. 1 through 7 can be used. although the top ring is modified slightly. In this instance the pipe mold includes outer mold case 14 and inner core 16. A reinforcing ring 88 with a beveled top edge and a beveled spigot ring 90 is disposed in the pipe mold between the core and the case. A beveled top ring assembly 92 includes an inner round-up ring 94 identical to ring 36 mounted on the top edge of core 16. An outer round-up ring 96 which engages the outer circumference of beveled spigot ring 90 supports a beveled facing ring 98 which defines the top surface of the beveled end section of the pipe. The bottoms of outer round-up ring 96 and bridge bars 99 are beveled so as to hold facing ring 98 in an inclined plane defining the desired bevel for the pipe.

In use, pouring chute assembly 26 is placed on top of beveled top ring 92, and the concrete is poured into the pipe mold. When the top level of the concrete reaches the low side of facing ring 98, the gate for the distribution channel going to the low side of the facing ring is closed to block the further rise of concrete through its corresponding door opening. As the concrete continues to rise and start to come through the adjacent door openings, the other two remaining gates are closed, as are their corresponding doors, and the concrete is poured again until it starts to come through the remaining door opening on the high side of facing ring 98. The last door is closed, and top ring 92 is eventually removed to provide a beveled end section which is planar continuously around the pipe and in which the bevel is formed at the desired elevation without requiring the hand finishing, troweling, and measuring procedures common in the prior art.

We claim:

1. A method of casting a beveled concrete pipe in a pipe mold which includes a cylindrical outer mold case, and an inner cylinder disposed concentrically inside the outer mold case to form an annular mold cavity into which concrete is to be poured, the method comprising the steps of:

(a) mounting the pipe mold so its axis is in an upright position;

(b) mounting above the annular mold cavity a facing ring having a generally flat bottom surface and a plurality of spaced apart openings which together occupy a minor portion of the facing ring area, the facing ring being mounted in a plane inclined from normal to the upright axis of the pipe mold, the openings in the facing ring being located at least on low, intermediate, and high points of said inclined plane, the facing ring having a plurality of spaced apart doors for opening and closing respective openings in the facing ring;

(c) mounting above the facing ring a plurality of pouring chutes each extending to a corresponding opening in the facing ring;

(d) pouring concrete through the pouring chutes and the openings in the facing ring and into the annular mold cavity and distributing the concrete in the mold cavity unitl the level of the concrete reaches the vicinity of the facing ring bottom surface;

(e) thereafter sequentially blocking further passage of concrete from the pouring chutes to the mold cavity to progressively block the rise of concrete in the mold cavity from the low side to the high side of the facing ring, and sequentially closing the doors in the facing ring, from the low side to the high side thereof, as the passage of concrete to the mold cavity is being progressively blocked, the bottom surface of each door being substantially flush with the flat bottom surface of the facing ring when each door is closed, the bottom surfaces of the closed doors cooperating with the facing ring bottom surface so that the rising concrete distributed in the pipe mold will come into contact substantially with the entire bottom surface of the facing ring and the bottom surfaces of the closed doors and form a smooth beveled end surface of the cast pipe; and (f) removing the pouring chutes and the facing ring from the pipe mold.

2. the method according to claim 1 including closing respective gates in the pouring chutes to sequentially block the passage of concrete to the mold cavity.

3. The method according to claim 1 in which the pipe mold includes a reinforcing cylinder disposed concentrically inside the outer mold case to form an annular outer mold cavity, and a cylindrical inner core disposed concentrically inside the reinforcing cylinder to form an annular inner mold cavity, and including the steps of:

(a) mounting the facing ring above only the outer mold cavity;

(b) mounting the pouring chutes above both mold cavities so the pouring chutes extend toward the corresponding openings in the facing ring; and (c) pouring concrete through the pouring chutes to distribute the concrete to the inner mold cavity and through the openings in the facing ring to the outer mold cavity.

4. The method according to claim 3 in which the cylindrical inner core has an annular top edge, and the facing ring has an annular inner edge and an annular support extending around the inner edge of the ring; and including the step of mounting the annular support so its rests on the annular top edge of the cylindrical inner core to hold the facing ring in its inclined position above the outer mold cavity.

5. The method according to claim 3 including periodically extending the length of the pouring chutes to circumvent the inner mold cavity and pour concrete directly through the openings of the facing ring and into the outer mold cavity.

6. The method according to claim 5 including continuously maintaining the level of the concrete in the inner mold cavity above that of the outer mold cavity to prevent the reinforcing cylinder from collapsing.

7. The method according to claim 3 including closing respective gates in the pouring chutes to sequentially block the passage of concrete to the mold cavity.

8. The method of casting concrete pipe in a pipe mold which includes a cylindrical outer mold case, a reinforcing cylinder disposed concentrically inside the outer mold case to form an annular outer mold cavity, and an inner cylindrical core disposed concentrically inside the reinforcing cylinder to form an annular inner mold cavity, the method comprising the steps of:

(a) mounting above the outer mold cavity a facing ring having a plurality of spaced apart openings which together occupy a minor portion of the facing ring area, the facing ring including a plurality of spaced apart doors for opening and closing respective openings in the facing ring, the facing being mounted in a plane inclined from norml to the upright axis of the pipe mold;

(b) mounting above the pipe mold a plurality of pouring chutes each being adapted to extend over a corresponding opening in the facing ring and over the inner mold cavity;

(c) pouring concrete through the pouring chutes to distribute the concrete to the inner and outer mold cavities, the mold cavities being filled by alternately distributing the concrete from the pouring chutes to the inner mold cavity and then extending the length of the pouring chutes to circumvent the inner mold cavity and pour concrete directly into the openings of the facing ring to the outer mold cavity, the concrete being distributed in both mold cavities so that the level of the concrete in the inner mold cavity is always filled to a level essentially above that of the outer mold cavity to prevent the reinforcing cylinder from collapsing, the outer mold cavity being filled with concrete to the bottom of the facing ring, the doors in the facing ring being sequentially closed from a low side to a high side of the facing ring as the outer mold cavity is filled with concrete to the bottom of the facing ring, the bottom surfaces of the closed doors cooperating with the facing ring bottom surface so the facing ring will form a smooth annular end surface of the cast pipe between the reinforcing cylinder and the outer mold case; and (d) removing the pouring chutes and the facing ring from the pipe mold.

9. The method according to claim 1 in which the pouring chutes extend downwardly to their respective openings from a pouring surface elevated above the facing ring; and including the steps of pouring the concrete onto said elevated pouring surface to channel the flow of concrete downwardly from the pouring surface through the respective pouring chutes and into the corresponding openings of the facing ring until the concrete reaches the vicinity of the facing ring.

10. The method according to claim 1 in which the pouring chutes extend downwardly to their respective openings from a pouring surface elevated above the facing ring; and including the steps of pouring the concrete onto said elevated pouring surface to channel the flow of concrete downwardly from the pouring surface through the respective pouring chutes and into the corresponding openings of the facing ring until the concrete reaches the vicinity of the facing ring.

11. The method of casting concrete pipe in a pipe mold which includes a cylindrical outer mold case, a reinforcing cylinder disposed concentrically inside the outer mold case to form an annular outer mold cavity, and an inner cylindrical core disposed concentrically inside the reinforcing cylinder to form an annular inner mold cavity, the method comprising the steps of:

(a) mounting the pipe mold so its axis is in an upright position;

(b) mounting above the outer mold cavity a facing ring having a plurality of spaced apart openings which together occupy a minor portion of the facing ring area, the facing ring being mounted in a plane inclined from normal to the upright axis of the pipe mold, the openings in the facing ring being located at least on low, intermediate, and high points of said inclined plane, the facing ring having a plurality of spaced apart doors for opening and closing respective openings in the facing ring;

(c) mounting above the pipe mold a plurality of pouring chutes each being adapted to extend over a corresponding opening in the facing ring and over the inner mold cavity;

(d) pouring concrete through the pouring chutes to distribute the concrete to the inner and outer mold cavities, the mold cavities being filled by alternately distributing the concrete from the pouring chutes to the inner mold cavity and then extending the length of the pouring chutes to circumvent the inner mold cavity and pour concrete directly into the openings of the facing ring and into the outer mold cavity, the concrete being distributed in both mold cavities so that the level of the concrete in the inner mold cavity is always filled to a level essentially above that of the outer mold cavity to prevent the reinforcing cylinder from collapsing, the outer mold cavity being filled with concrete until the level of the concrete therein reaches the vicinity of the facing ring;

(e) thereafter sequentially blocking the further passage of concrete from the pouring chute to the outer mold cavity to progressively block the rise of concrete therein from the low side to the high side of the facing ring so that the rising concrete distributed in the outer mold cavity will come into contact substantially with the entire bottom surface of the facing ring, the doors of the facing ring being progressively closed, from the low side to the high side of the facing ring, as the passage of concrete to the outer mold cavity is being progressively blocked, the bottom surface of each door being substantially flush with the bottom surface of the facing ring when each door is closed, the bottom surfaces of the closed doors cooperating with the facing ring bottom surface to form a smooth beveled annular end surface of the cast pipe between the reinforcing cylinder and the outer mold case; and (f) removing the pouring chutes and the facing ring from the pipe mold.

12. The method according to claim 11 in which the pouring chutes extend downwardly to their respective openings from a pouring surface elevated above the facing ring; and including the step of pouring the concrete onto said elevated pouring surface to channel the flow of concrete downwardly from the pouring surface through the respective pouring chutes and into the corresponding openings of the facing ring until the concrete reaches the vicinity of the facing ring.

13. The method according to claim 11 including closing respective gates in the pouring chutes to sequentially block the passage of concrete to the mold cavity.

* * * * *

UNITED STATES PATENT AND TRADEMARK OFFICE

CERTIFICATE OF CORRECTION

PATENT NO. : 4,101,622

DATED : July 18, 1978

INVENTOR(S) : FRANK M. WELLS ET AL

It is certified that error appears in the above-identified patent and that said Letters Patent are hereby corrected as shown below:

Col. 3, line 7, "cross-section" should read -- cross-sectional --;

line 65, "rings" should read -- ring --.

Col. 4, line 6, "forms" should read -- form --.

Col. 6, line 33, "arts" should read -- art --.

Col. 7, line 35, "unitl" should read -- until --. (Claim 1)

Col. 8 line 41, after "facing" (2nd occurrence) insert -- ring --;
(Claim 8)

line 42, "norml" should read -- normal --.

Signed and Sealed this

*Third* Day of *April 1979*

[SEAL]

*Attest:*

RUTH C. MASON
*Attesting Officer*

DONALD W. BANNER
*Commissioner of Patents and Trademarks*